US007850784B2

(12) United States Patent
Gunnerson et al.

(10) Patent No.: US 7,850,784 B2
(45) Date of Patent: Dec. 14, 2010

(54) LID SEAL FOR A DRAWER-TYPE DISHWASHER

(75) Inventors: Kory A. Gunnerson, West Lafayette, IN (US); Kristen K. Hedstrom, Orlando, FL (US); Seungwon Chris Song, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 649 days.

(21) Appl. No.: 11/288,234

(22) Filed: Nov. 29, 2005

(65) Prior Publication Data

US 2007/0119482 A1 May 31, 2007

(51) Int. Cl.

| | |
|---|---|
| ***A47L 15/44*** | (2006.01) |
| ***A47L 15/42*** | (2006.01) |
| ***F16J 15/53*** | (2006.01) |
| ***D06F 39/14*** | (2006.01) |

(52) U.S. Cl. ..... 134/25.2; 134/114; 134/115 R; 134/57 D

(58) Field of Classification Search ..... 134/25.2
See application file for complete search history.

(56) References Cited

U.S. PATENT DOCUMENTS

| | | | | |
|---|---|---|---|---|
| 2,657,475 | A * | 11/1953 | Erickson | 34/139 |
| 2,661,750 | A | 12/1953 | McNairy | |
| 2,668,091 | A | 2/1954 | Clark | |
| 3,169,541 | A | 2/1965 | Cushing | |
| 3,458,241 | A | 7/1969 | Barnard et al. | |
| 3,727,622 | A * | 4/1973 | Jacobs | 134/183 |
| 4,758,004 | A | 7/1988 | Semon | |
| 5,755,244 | A | 5/1998 | Sargeant et al. | |
| 5,860,300 | A * | 1/1999 | Valent | 68/24 |
| 6,189,551 | B1 | 2/2001 | Sargeant et al. | |
| 6,256,823 | B1 * | 7/2001 | Kronbetter et al. | 8/158 |
| 6,398,495 | B1 * | 6/2002 | Kazianus | 415/206 |
| 6,442,981 | B1 * | 9/2002 | Augustsson | 68/139 |
| 6,447,081 | B1 | 9/2002 | Sargeant et al. | |
| 6,460,555 | B1 | 10/2002 | Tuller et al. | |
| 6,491,049 | B1 | 12/2002 | Tuller et al. | |
| 6,560,998 | B2 * | 5/2003 | Wright | 68/139 |
| 6,571,808 | B2 | 6/2003 | Todd | |

(Continued)

FOREIGN PATENT DOCUMENTS

| | | |
|---|---|---|
| DE | 3919773 | 12/1990 |

(Continued)

*Primary Examiner*—Michael Barr
*Assistant Examiner*—Jason P Riggleman
(74) *Attorney, Agent, or Firm*—Robert A. Bacon; Diederiks & Whitelaw PLC

(57) ABSTRACT

A drawer-type dishwasher includes a frame assembly, a wash tub slidably mounted in the frame assembly, and a lid member. The lid member can be lowered onto the wash tub when the wash tub is shifted into the frame assembly, and raised when the wash tub is shifted out of the frame assembly. The lid member includes a seal element that abuts the wash tub when the lid member is lowered. The seal element includes a base portion, an angled, deflecting finger portion and a flat pad portion which projects from the base portion. When the seal element is urged against the wash tub, a compressive force is applied to the flat pad portion causing the deflecting finger to seal against the wash tub in a manner that substantially shields the deflecting finger from excessive compressive forces.

19 Claims, 4 Drawing Sheets

U.S. PATENT DOCUMENTS

| | | | | |
|---|---|---|---|---|
| 6,578,587 | B2 | 6/2003 | Matsuno et al. | |
| 6,761,049 | B2 * | 7/2004 | Nitschmann et al. | 68/5 E |
| 6,862,903 | B2 * | 3/2005 | Nitschmann et al. | 68/5 E |
| 6,931,761 | B2 * | 8/2005 | Hwang | 34/601 |
| 7,293,437 | B2 * | 11/2007 | Kim et al. | 68/23 A |
| 7,357,006 | B2 * | 4/2008 | Kim et al. | 68/23.1 |
| 7,398,662 | B2 * | 7/2008 | Kim et al. | 68/23 A |

FOREIGN PATENT DOCUMENTS

| | | |
|---|---|---|
| EP | 0 665 399 A1 | 8/1995 |
| GB | 2130479 | 6/1984 |
| GB | 2198332 | 6/1988 |
| GB | 2201886 | 9/1988 |
| JP | 2001087200 | 4/2001 |
| JP | 2002065570 | 3/2002 |
| JP | 2002200026 | 7/2002 |
| JP | 2002238826 | 8/2002 |
| JP | 2002282192 | 10/2002 |
| JP | 2002-360495 | 12/2002 |
| JP | 2002345716 | 12/2002 |
| JP | 2003024258 | 1/2003 |
| JP | 2004-360717 | 12/2004 |
| JP | 2005-177280 | 7/2005 |
| WO | 98/33426 | 8/1998 |

* cited by examiner

LID SEAL FOR A DRAWER-TYPE DISHWASHER

BACKGROUND OF THE INVENTION

1. Field of the Invention

The present invention pertains to the art of dishwashers and, more particularly, to a seal provided on a lid of a drawer-type dishwasher for preventing washing fluid from escaping from a wash tub.

2. Discussion of the Prior Art

In general, dishwashers having pull-out drawers are known in the art. In some cases, the dishwasher will include an upper, pull-out drawer defining a wash tub for washing smaller objects such as glassware, utensils, small plates and the like, and a lower, conventional-type dishwasher for washing larger objects such as plates. In other cases, the dishwasher will include upper and lower pull-out wash tubs, or just simply be provided with a single pull-out type wash tub. In any event, the pull-out wash tub must include a lid having a water-tight seal to prevent washing fluid from leaking from the dishwasher during a washing operation.

In certain known prior art, the lid is pivotally mounted to the dishwasher above the pull-out wash tub. With this arrangement, the lid is elevated from the wash tub when the drawer is withdrawn from the dishwasher, and lowered onto the wash tub when the drawer is inserted back into the dishwasher. This design requires a seal or gasket to be provided either on the lid or about an upper portion of the wash tub.

In accordance with some arrangements, once the lid is positioned over the wash tub, a seal is inflated with air to ensure a proper, water tight fit. In general, this arrangement requires a compressor and tubing that are interconnected to the seal. If a failure occurs in any of these components, the overall seal will fail, allowing washing fluid to escape from the wash tub. In addition, as the inflatable seal is subjected to repeated operation in a somewhat harsh environment, over time the seal can become brittle and develop a leak.

Other arrangements employ a seal having a bellows or compression pad that is forced against an upper portion of the wash tub. In a manner similar to that described above, the compressive forces that are applied to the compression pad can eventually cause the seal to warp and possibly allow washing fluid to escape from the wash tub.

Regardless of the existence of seals in the prior art, there still exists a need for an improved sealing arrangement for a wash tub lid of a drawer-type dishwasher. More specifically, there exists a need for a sealing arrangement that is able to withstand repeated applications of compression force without allowing a substantial portion of the compression force to be transferred to a sealing surface, thereby enhancing the effective useful life of the sealing arrangement.

SUMMARY OF THE INVENTION

The present invention is directed to a drawer-type dishwasher incorporating a seal element that prevents washing fluid from escaping from a wash tub portion of the dishwasher. The dishwasher includes a frame assembly, a drawer which defines the wash tub and is slidably mounted in the frame assembly, and a lid member. The lid member is mounted so as to be lowered against the wash tub when the drawer is shifted into the frame assembly, and raised when the drawer is shifted out of the frame assembly. In accordance with the invention, the lid member is provided with a seal element that is urged against an upper edge portion of the wash tub when the lid is lowered.

In accordance with the most preferred embodiment of the invention, the seal element is secured about a peripheral edge of the lid member. Specifically, the seal element includes a base portion, a deflecting finger portion and a flat pad portion. The flat pad portion projects from the base portion to form a corner section, with the deflecting finger portion projecting at an angle therefrom. With this arrangement, when the seal element is urged against the wash tub, a compressive force is applied to the flat pad portion causing the deflecting finger to seal against the wash tub in a manner that shields the deflecting finger from most of the compressive force. Since the deflecting finger is shielded from the compressive force, the overall life of the seal is extended.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
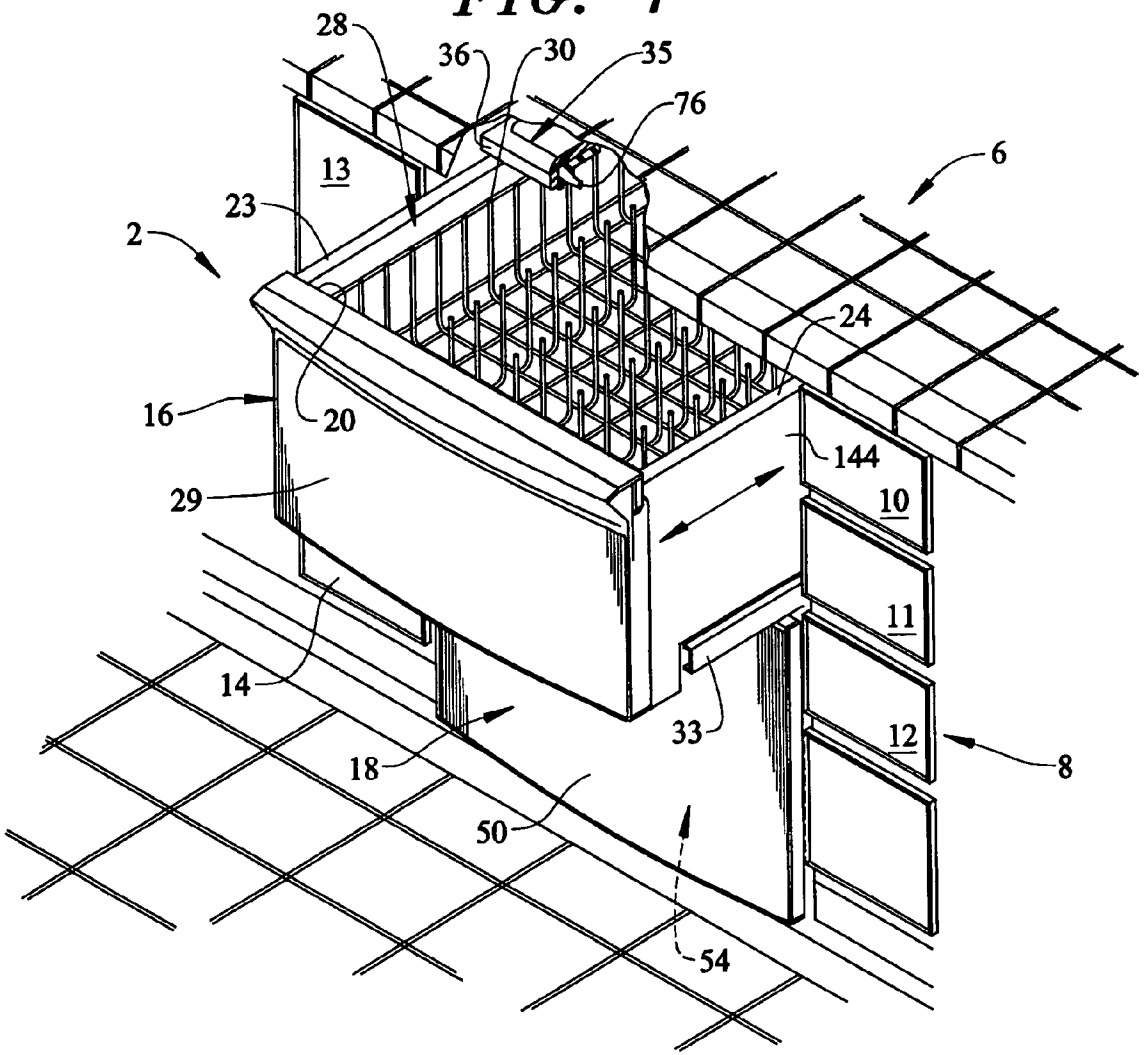
FIG. 1 is an upper right perspective, partially cut-away view of a dishwasher having upper and lower wash tubs incorporating a lid sealing arrangement constructed in accordance with the present invention.
Figure 2:
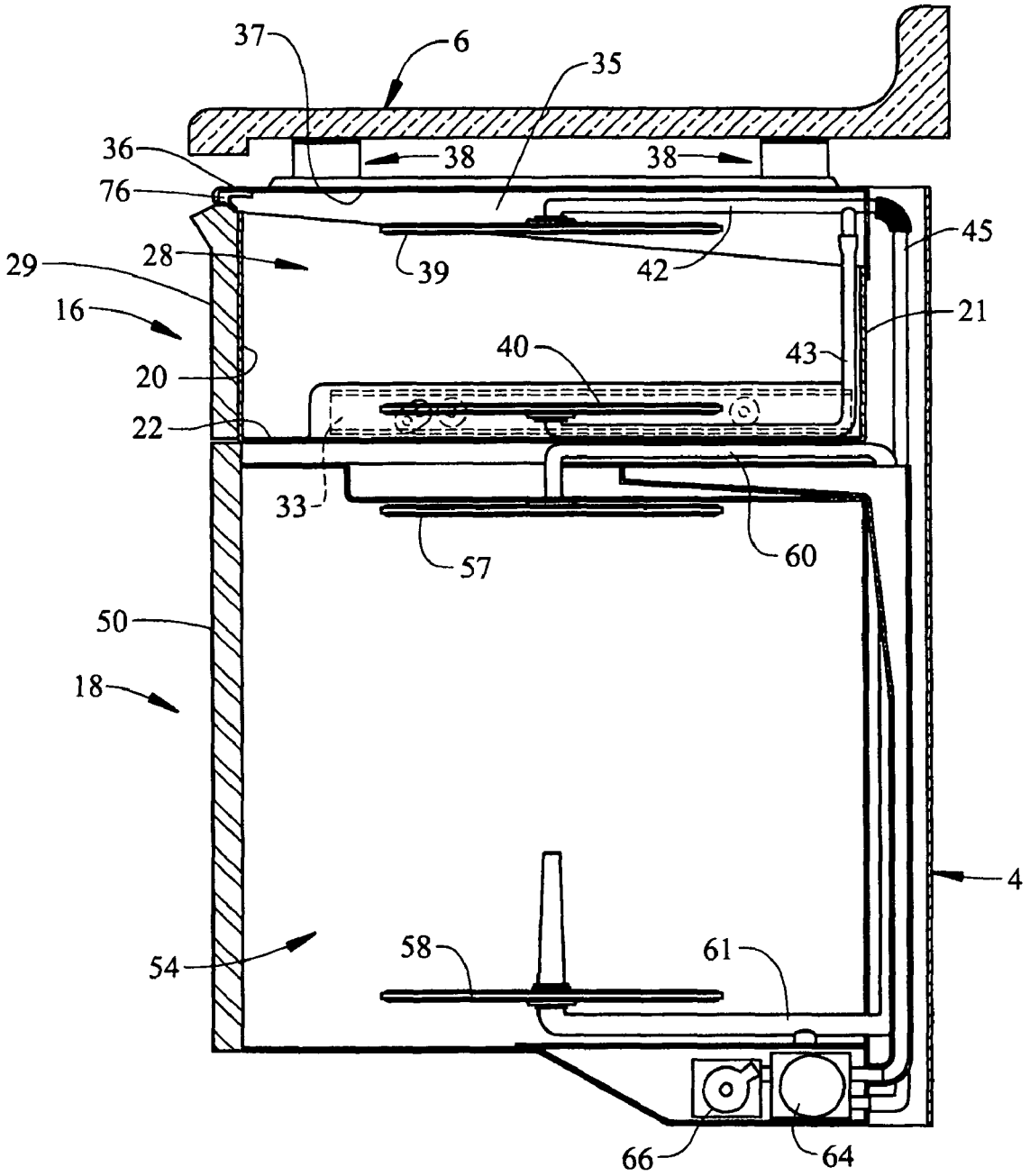
FIG. 2 is a cross-sectional side view of the dishwasher of FIG. 1.
Figure 3:
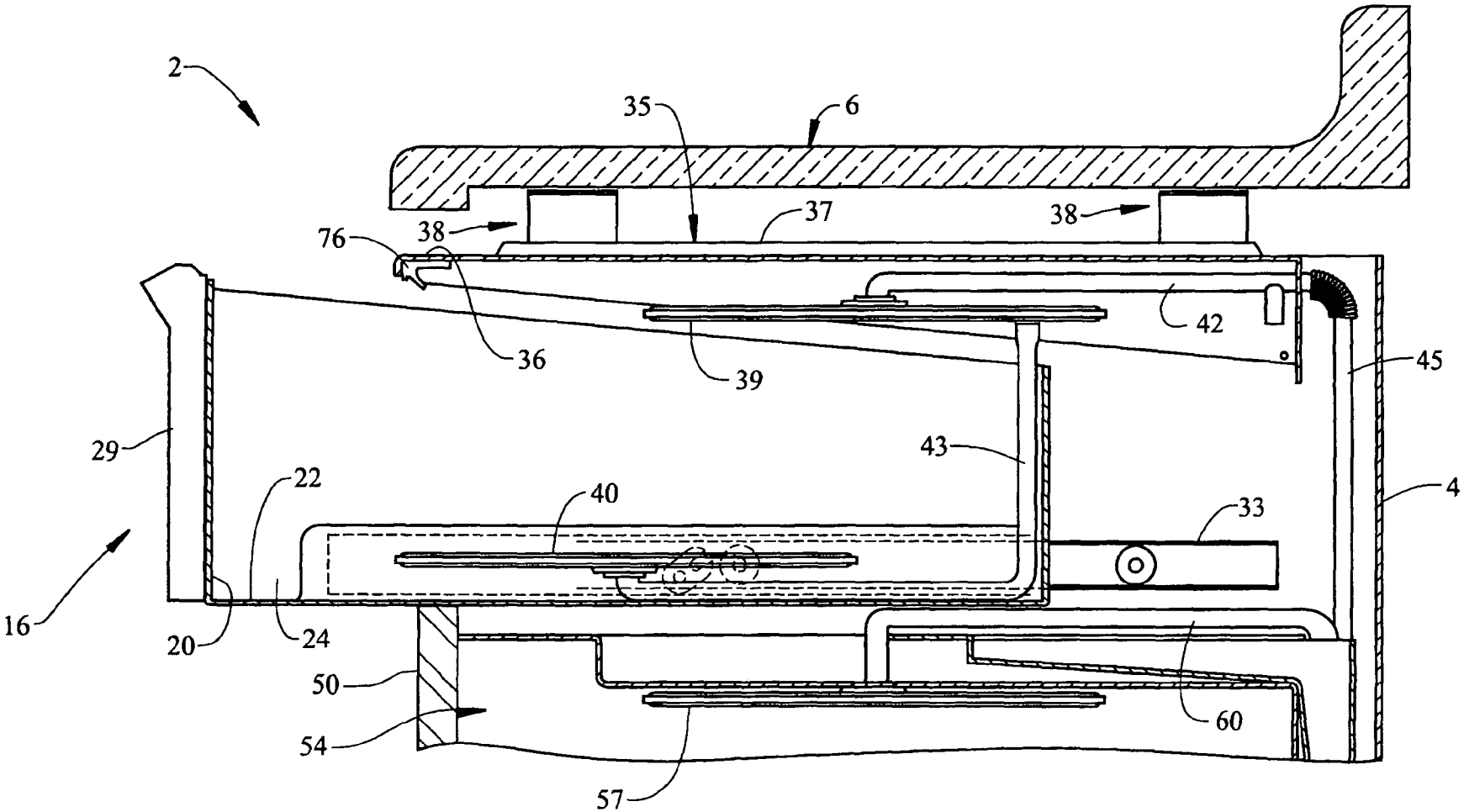
FIG. 3 is an enlarged, cross-sectional side view of the upper tub and lid of FIG. 2, particularly depicting the lid sealing arrangement constructed in accordance with the present invention.

With initial reference to FIGS. 1-3, a drawer-type dishwasher constructed in accordance with the present invention is generally indicated at 2. As shown, dishwasher 2 includes a support frame 4 that is arranged below a kitchen countertop 6. Also below kitchen countertop 6 is shown cabinetry 8 including a plurality of drawers 10-12, as well as cabinet doors 13 and 14. Although the actual dishwasher into which the present invention may be incorporated can vary, the invention is shown in connection with dishwasher 2 depicted as a dual cavity, drawer-type dishwasher having an upper washing unit 16 and a lower washing unit 18. As further illustrated, upper washing unit 16 takes the form of a slide-out drawer unit while lower cavity 18 is illustrated as a conventional-type dishwasher. However, it should be understood that dishwasher 2 could also constitute a dual-drawer or even a single-drawer model.

In accordance with the invention, upper unit or drawer 16 is shown to include a front wall 20, a rear wall 21, a bottom wall 22 and opposing side walls 23 and 24 that collectively define an upper wash tub 28. In addition, drawer 16 is provided with a decorative facade 29 that is secured to front wall 20. In a manner known in the art, upper wash tub 28 is provided with a dish rack 30 for supporting various objects, such as dishware, glassware, and the like to be exposed to a washing operation. Upper wash tub 28 is slidably supported within support frame 4 through a pair of extensible support guides, one of which is indicated at 33. With particular reference to FIG. 2, upper drawer 16 is provided with a lid assembly 35 which, as will be discussed more fully below, is employed to selectively seal wash tub 28 during a washing operation.

In accordance with the invention, lid assembly 35 includes an outer peripheral edge 36 that surrounds and defines a cover section 37. Lid assembly 35 is provided with a movable support mechanism 38 that is employed to raise and lower lid assembly 35 relative to wash tub 28. As the specific structure and operation of support mechanism 38 is not part of the invention, it will not be discussed further here. Instead, reference is made to co-assigned U.S. Pat. No. 6,491,049 entitled "Lid Construction for Drawer Dishwasher", which issued Dec. 10, 2002, and co-owned U.S. Patent Application entitled "Latching and Sealing Mechanism for a Drawer-Type Dishwasher" filed on even date herewith, both of which are incorporated herein by reference. As further shown in FIG. 2, wash tub 28 is provided with a plurality of spray arms 39 and 40 for directing a washing liquid onto objects placed within wash tub 28. Toward that end, upper spray arm 39 is arranged on lid assembly 35 for directing washing liquid downward onto articles supported on rack 30, and lower spray arm 40 is arranged above bottom wall 22 for directing washing liquid upward onto the objects placed within wash tub 28. Upper and lower spray arms 39 and 40 are supplied by conduits 42 and 43 respectively, with each of conduits 42 and 43 being interconnected to a supply conduit 45.

For the sake of completeness, lower washing unit 18 is provided with a door 50 for selectively closing a lower washing chamber 54. As shown, lower washing chamber 54 is provided with an upper spray arm 57 for directing washing liquid downward onto articles placed within lower washing chamber 54, as well as a lower spray arm 58 for directing washing liquid upward onto articles supported on a rack (not shown). Upper and lower spray arms 57 and 58 are supplied by respective conduits 60 and 61 that, along with supply conduit 45, are in fluid communication with a pump 64 that is driven by a motor 66. Finally, upper and lower washing units 16 and 18 are provided with respective drain portions (not shown) for returning washing liquid from upper wash tub 28 and lower wash chamber 54. In general, the structure set forth above with respect to dishwasher 2 is provided for a better understanding of the drawings and has only been described for the sake of completeness. Instead, the present invention is particularly directed to a seal 76 that extends about outer peripheral edge 36 of lid assembly 35 for preventing washing fluid from escaping out of wash tub 28 during a washing operation.

Figure 4:
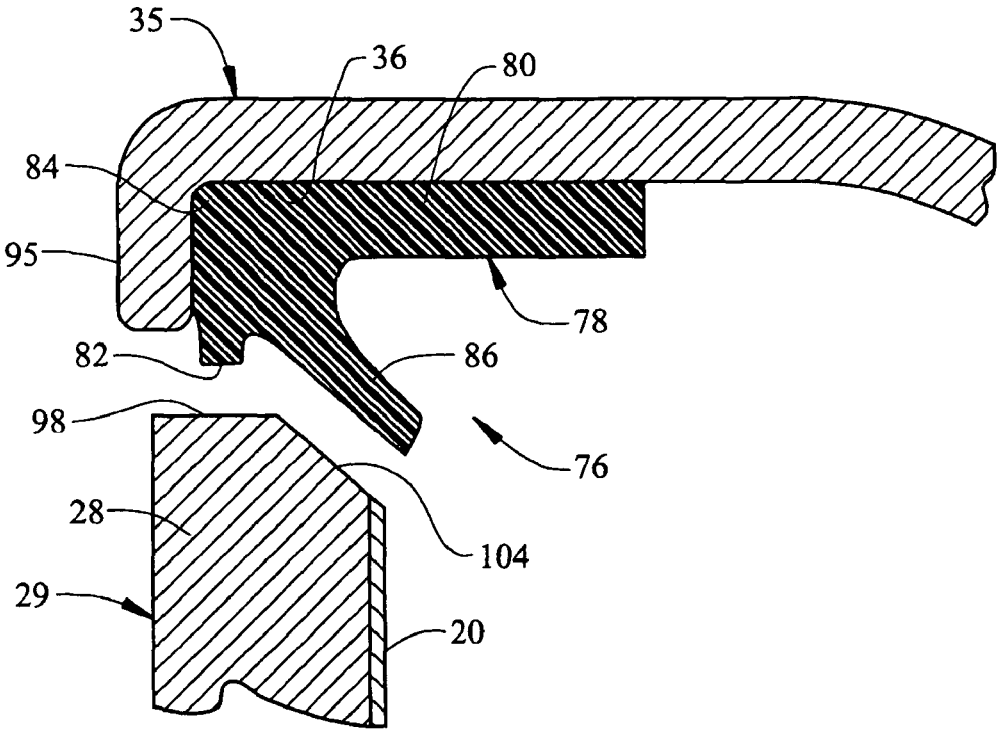
FIG. 4 is a partial cross-sectional detail view of a portion of the upper tub of the dishwasher, with the lid and seal positioned over a front wall of the dishwasher tub.

With particular reference to FIG. 4, seal element 76 is shown in cross-section secured to outer peripheral edge 36 of lid member 35. In accordance with the invention, seal element 76 includes a main body 78 having a base portion 80. Actually, seal element 76 is secured to outer peripheral edge 36 through base portion 80 using, for example, mechanical fasteners, such as screws or rivets, or by other known fastening means including an adhesive or epoxy. In any case, base portion 80 extends to a flat pad portion 82 through corner section 84. Preferably, flat pad portion 82 projects substantially perpendicularly from base portion 80 through corner section 84. Seal element 76 is further provided with a deflecting finger portion 86 that projects inward, at an angle from corner section 84.

Figure 5:
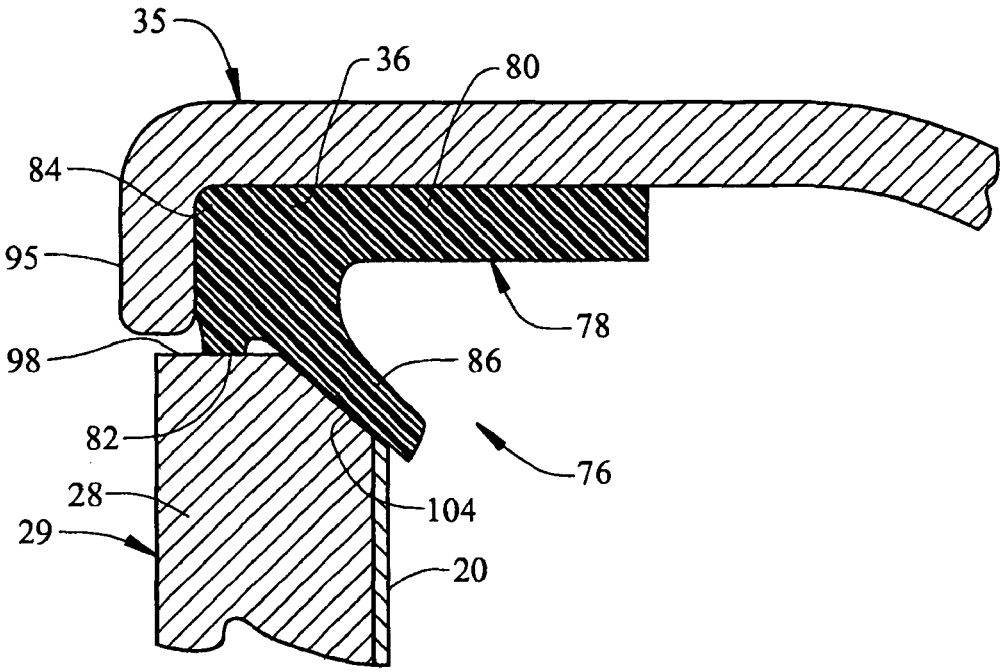
FIG. 5 is a partial cross-sectional detail view of a portion of the upper tub of the dishwasher, with the lid and seal positioned in contact with the front wall of the dishwasher tub.

In accordance with the most preferred form of the invention, outer peripheral edge 36 extends to a down-turned flange segment 95. Down-turned flange segment 95 extends about a perimeter (not separately labeled) of lid assembly 35. With this particular arrangement, when lid assembly 35 is moved to the lowered position, flat pad portion 82 of seal element 76 is forced against an upper peripheral lip or rim 98 of wash tub 28. Flat pad portion 82 is forced into engagement through application of a compressive force provided by support mechanism 38. As lid assembly 35 is fully engaged about wash tub 28, flat pad portion 82 compresses so as to allow deflecting finger portion 86 to seal against an angled or tapered portion 104 that leads from peripheral rim 98 to front wall 20 of upper washing unit 16 as shown in FIG. 5. In this manner, deflecting finger portion 86 serves as the primary seal for wash tub 28.

In accordance with the most preferred form of the invention, the majority of the compressive force provided by support mechanism 38 is translated through flat pad portion 82 onto peripheral rim 98. Therefore, deflecting finger portion 86 engages with angled surface 104 with relatively little force. Actually, once lid assembly 35 is fully seated and flat pad portion 82 is fully compressed, deflecting finger portion 86 will deflect approximately 0.080 inches (2.03 mm). In order to achieve the proper deflection, seal element 76 is formed from a flexible, elastomeric material having a durometer value of approximately 0.25 lbf per linear inch. In this manner, continued operation, i.e., raising and lowering of lid assembly 35 onto upper peripheral edge 98, will not cause seal element 76 to degrade in any significant manner. That is, compression of flat pad portion 82 allows the overall lid assembly 35 to sit in a compressed state without excessive force being applied to deflecting finger portion 86.

Although described with reference to a preferred embodiment of the present invention, it should be readily apparent to one of ordinary skill in the art that various changes and/or modifications can be made to the invention without departing from the spirit thereof. For instance, while the material for the seal is described as having a particular durometer value, other materials that would achieve the desired functions set forth above would also be acceptable. In addition, the amount of deflection could vary without departing from the scope of the present invention so long as the deflection finger is substantially shielded from the compressive force applied to the lid member. In general, the invention is only intended to be limited by the scope of the following claims.

We claim:

1. A dishwasher comprising:

a frame;

a drawer slidably mounted in the frame, said drawer including a bottom wall and a plurality of side walls that collectively define a wash tub, each of said plurality of side walls including an upper rim portion defining an opening for the wash tub, wherein the wash tub includes a tapered section that extends inward from the upper rim portion;

a lid member including a peripheral edge mounted to the frame above the wash tub, said lid member being movable between a first position, wherein the lid member is positioned above the wash tub, to a second position, wherein the lid member is positioned on the wash tub across the opening; and a seal element secured about the lid member, said seal element including a base portion, a deflecting finger portion and a pad portion, both said pad portion and said deflecting finger portion projecting from the base portion, with said deflecting finger portion extending at an angle relative to the pad portion, wherein said seal element is urged against the upper rim portion with the deflecting finger sealing against the tapered section of the wash tub so as to prevent washing fluid from escaping from the wash tub when the lid member is in the second position.

2. The dishwasher according to claim 1, wherein the pad portion projects substantially perpendicularly from the base portion.

3. The dishwasher according to claim 2, wherein the pad portion seats substantially flat against the upper peripheral rim portion of the wash tub.

4. The dishwasher according to claim 1, wherein the base portion is secured to the peripheral edge of the lid member.

5. The dishwasher according to claim 4, wherein the peripheral edge of the lid member extends to a down-turned flange segment, said sealing element being positioned on the peripheral edge at the down-turned flange segment.

6. The dishwasher according to claim 5, wherein the deflecting finger seats against an inner surface of the peripheral edge.

7. The dishwasher according to claim 1, wherein the lid member is urged against the wash tub with a compression force, with a majority of the compression force being applied to the pad portion.

8. The dishwasher according to claim 1, wherein the deflecting finger portion constitutes a primary seal between the drawer and the lid member.

9. The dishwasher according to claim 1, wherein the sealing element is made from a flexible, elastomeric material having a durometer value of approximately 0.25 lbf per liner inch.

10. A dishwasher comprising:

a frame;

a drawer slidably mounted in the frame, said drawer including a bottom wall and a plurality of side walls that collectively define a wash tub, each of said plurality of side walls including an upper rim portion defining an opening for the wash tub;

a lid member including a peripheral edge mounted to the frame above the wash tub, said lid member being movable between a first position, wherein the lid member is positioned above the wash tub, to a second position, wherein the lid member is positioned on the wash tub across the opening; and a sealing element, including a base portion, interposed and compressed between the upper rim portion of the drawer and the lid member so as to prevent washing fluid from escaping from the wash tub when the lid member is in the second position, said sealing element including first and spaced second portions projecting from the base portion at different angles, with the first portion being subjected to a majority of a compression force applied to the sealing element and the second portion defining a deflecting finger having a length, with the deflecting finger seating against the wash tub along a substantial portion of the length and constituting a primary seal between the drawer and the lid member.

11. The dishwasher according to claim 10, wherein the first portion of the sealing element constitutes a pad portion that projects substantially perpendicularly from the base portion.

12. The dishwasher according to claim 10, wherein the pad portion seats substantially flat against the upper rim portion of the wash tub.

13. The dishwasher according to claim 10, wherein the base portion is secured to the peripheral edge of the lid member.

14. The dishwasher according to claim 13, wherein the peripheral edge of the lid member extends to a down-turned flange segment, said seal element being positioned on the peripheral edge at the down-turned flange segment.

15. The dishwasher according to claim 14, wherein the deflecting finger seats against an inner surface of the peripheral edge.

16. The dishwasher according to claim 10, wherein the wash tub includes a tapered section that extends inward from the upper rim portion, said deflecting finger being adapted to seal against the tapered section.

17. The dishwasher according to claim 10, wherein the sealing element is made from a flexible, elastomeric material having a durometer value of approximately 0.25 lbf per liner inch.

18. A method of sealing a lid member on a wash tub of a drawer-type dishwasher comprising:

slidably positioning the wash tub into a recessed position;

lowering a lid member onto the wash tub;

deflecting an angled finger portion of a sealing element, carried by the lid member, into engagement with an angled surface of a rim portion of the wash tub in order to seat the angled finger portion, along substantially its entire length, against the rim portion of the wash tub; and compressing a pad portion of the sealing element against the rim portion of the wash tub, wherein said pad portion prevents excessive force from being transferred to the finger portion.

19. The method of claim 18, wherein the finger portion deflects approximately 0.080 inches (2.03 mm).

* * * * *